US005325554A

United States Patent [19]

Lewis

[11] Patent Number: 5,325,554

[45] Date of Patent: Jul. 5, 1994

[54] RETAINER FOR BEDCLOTHES

[76] Inventor: David M. Lewis, 2307 SW. 15th St., Apt. #6, Deerfield Beach, Fla. 33442

[21] Appl. No.: 993,680

[22] Filed: Dec. 21, 1992

[51] Int. Cl.[5] ..... A47C 21/02

[52] U.S. Cl. ..... 5/498; 5/496; 5/460

[58] Field of Search ..... 5/496, 498, 494, 485, 5/460, 499

[56] References Cited

U.S. PATENT DOCUMENTS

| | | | |
|---|---|---|---|
| 807,658 | 12/1905 | Campbell . | |
| 876,410 | 1/1908 | Stone | 5/496 |
| 1,347,413 | 7/1920 | Schaefer | 5/498 |
| 1,438,475 | 12/1922 | Bisbing . | |
| 2,024,050 | 12/1935 | May | 5/498 |
| 2,241,466 | 5/1941 | Lovick | 5/498 |
| 2,727,565 | 12/1955 | Moser | 5/498 |
| 2,826,766 | 3/1958 | Stoner | 5/320 |
| 2,860,352 | 11/1958 | Pierre | 5/320 |
| 2,896,226 | 7/1959 | Swicegood | 5/320 |
| 2,979,737 | 4/1961 | Pierre | 5/498 |
| 3,011,182 | 12/1961 | Burks | 5/496 |
| 3,092,848 | 6/1963 | Gronvold | 5/498 |
| 3,564,670 | 2/1971 | Bengtsson | 24/126 |
| 3,606,622 | 9/1971 | Williams | 5/336 |
| 4,100,632 | 7/1978 | Johnson | 5/334 R |
| 4,199,830 | 4/1980 | Ogata | 5/498 |
| 4,222,139 | 9/1980 | Svedberg-Reker | 5/498 |
| 4,506,398 | 3/1985 | Hruban | 5/498 |
| 4,572,174 | 2/1986 | Eilender | 5/485 |

FOREIGN PATENT DOCUMENTS

| | | | |
|---|---|---|---|
| 506712 | 11/1951 | Belgium | 5/498 |

*Primary Examiner*—Flemming Saether
*Attorney, Agent, or Firm*—Alvin S. Blum

[57] ABSTRACT

A retaining system holds sheet material smooth and flat upon a mattress against the movements of a bed occupant. Opposing edges of the sheet are provided with hems for removably receiving elongate rigid slats or battens. At the midpoint of each batten is an attaching means. An aperture in each hem provides access to the attaching means. A flaccid cord or tape assembly is passed beneath the mattress. The cord is provided at its ends with connectors for connection to the attaching means on the battens. The cord is pulled taut and held under tension. This pulls the battens down along the sides of the mattress and holds the sheet smooth and taut against the mattress.

9 Claims, 1 Drawing Sheet

FIG. 5
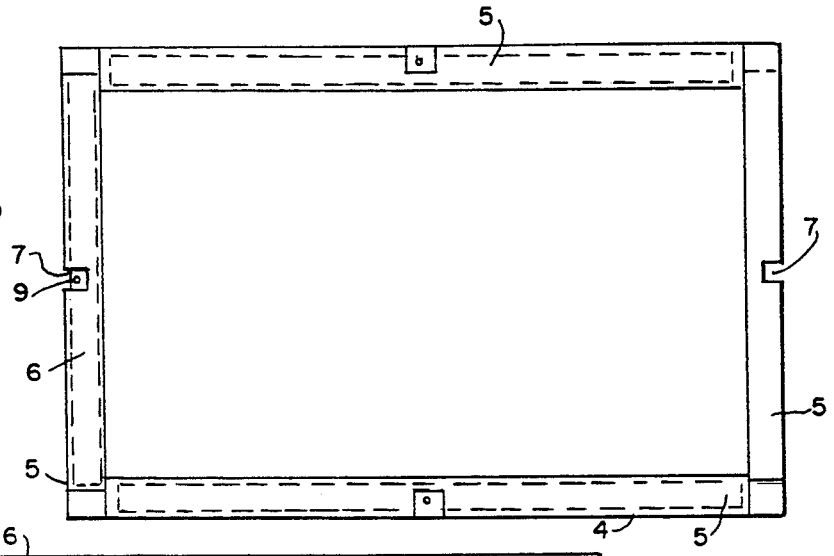
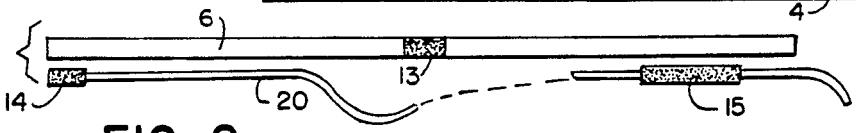
FIG. 6
FIG. 2
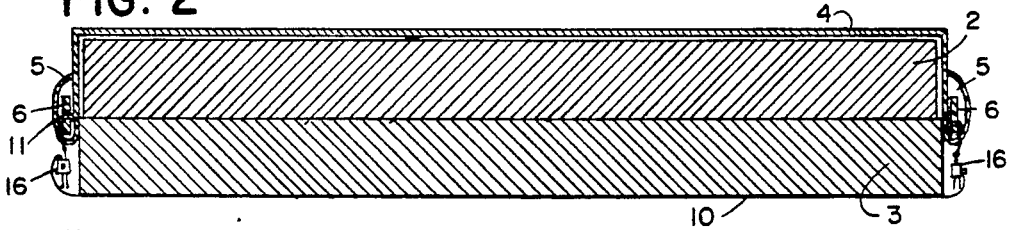
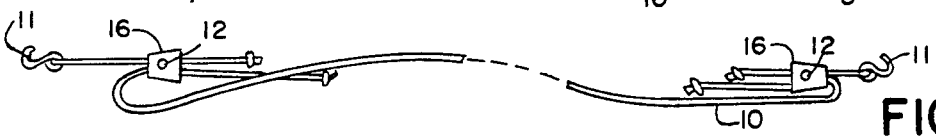
FIG. 3
FIG. 4
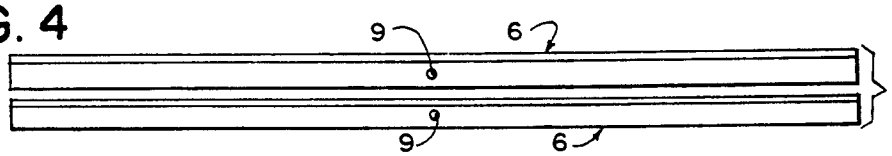
FIG. 1
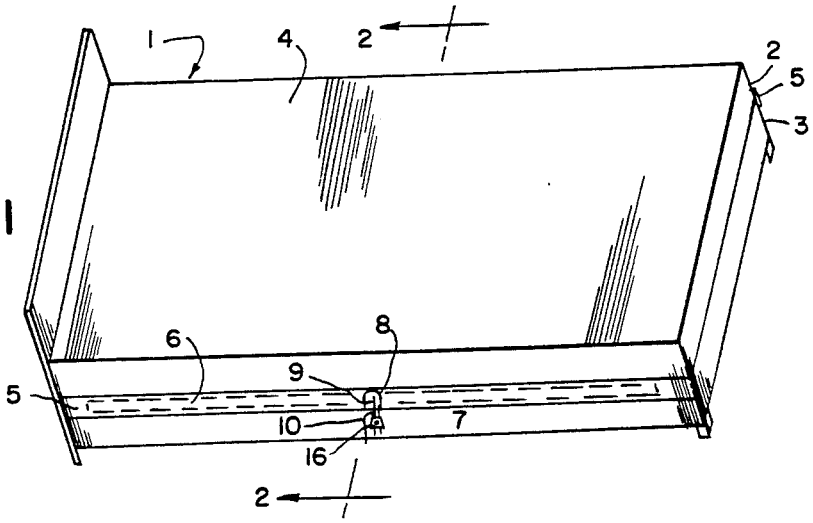

RETAINER FOR BEDCLOTHES

BACKGROUND OF THE INVENTION

This invention relates to bedclothes and more particularly to means for holding bedclothes of sheet material such as sheets, blankets, bedpads and the like in place under tension on a bed so as to prevent their being displaced by the movements of the bed occupant.

The use and operational positioning and retention of bedding and bed sheets, on mattresses presents annoying problems that were addressed in U.S. Pat. Nos. 2,826,766; 2,860,352; 2,896,226; 2,979,737; 3,606,622; 4,100,632; and 807,658. Some of these require changes to the bed and others are awkward to operate. There remains a need for a device which does not require changes to the bed, that permits conventional laundering of the bedclothes, that is inexpensive to implement and that is easy to operate and to apply tension from one side of the bed.

SUMMARY OF THE INVENTION

It is accordingly an object of the invention to provide economical means for retaining the bedclothes on a mattress that easily hold the sheet material in a smooth and unwrinkled fashion by applying uniform tensile forces from opposing sides in a system that may be easily operated from one side of the bed. It is another object that the system be applicable without modification of the bed or mattress. It is yet another object of the invention that the system may not affect the laundering of the sheet material.

The invention comprises a pair of elongate battens or slats that fit into sleeves formed at the opposed edges of the sheet material. An aperture is formed at the midpoint of each sleeve. Each batten is readily removed from its sleeve when the sheet is to be laundered, and is readily slipped into the sleeve for use. A limp cord or tape assembly connects at each end to the midpoint of one of the battens through the aperture in the sleeve. The cord or tape assembly is passed beneath the mattress, spring or bed and attached at its ends to the two battens. The cord or tape assembly is provided with means for shortening the distance between its ends to thereby pull the sheet down onto the mattress and apply tension from opposed sides to thereby hold it smooth and flat against the movements of the user.

These and other objects, advantages and features of the invention will become more apparent when the detailed description is studied in conjunction with the drawings in which:

BRIEF DESCRIPTION OF THE DRAWINGS

FIG. 1 shows a perspective view of a bed with the invention in use thereon.

FIG. 2 is a sectional view taken on line 2—2 of FIG. 1.

FIG. 3 is a plan view of the tension cord assembly of the invention.

FIG. 4 is a perspective view of the battens of the invention.

FIG. 5 is a plan view of the sheet of the invention with one batten in place.

FIG. 6 is a plan view of the tension assembly and battens of an alternative embodiment of the invention.

DETAILED DESCRIPTION OF PREFERRED EMBODIMENTS OF THE INVENTION

Referring now first to FIGS. 1–5, a bed 1 comprising a mattress 2 on a box spring 3 of convention construction and unchanged by the invention is covered by a sheet 4 of special construction having sleeve-like hems 5 on opposed sides, each arranged to removably receive therein an elongate, rigid slat or batten 6. An aperture 7 in the hem at the mid-point of the hem provides access to the batten at its mid-point 8. A through hole grommet 9 is provided at the mid-point 8 of each batten for attachment to opposed ends of a flaccid tape or cord 10 by removable attachment means such as a hook 11 for passing through the grommet. The cord includes an intermediate portion which passes beneath the underside of the mattress and end portions which extend upward along opposed sides of the mattress. The cord 10 is passed between the mattress 2 and box spring 3 or beneath the box spring. Shortening means 16 are provided at each end portion for shortening the distance between the ends attached to the battens to apply uniform tension and downward thrust on the sheet to hold the sheet smooth and flat against the mattress and to retain it in place against the many movements of the bed occupant. The battens have sufficient rigidity to distribute the tension force along the hem. The shortening means 16 may take a variety of forms well known in the art such as buckles and the cord locking device 16 shown here which is marketed as cord-lock from Fastex of Des Plaines described in U.S. Pat. No. 3,564,670 issued Feb. 23, 1971 to Bengtsson. In this device the two cords are pulled through the locking device 16 until the desired tension is achieved. The device holds the cords in tension until the button 12 is depressed when the sheets are to be changed. The cords and batten are inconspicuous, especially when covered with blankets and bedspread. The same system can be used to hold a first bedpad in position and then a bottom sheet may be held in place over it with another cord and set of battens. The system may be used on the lateral sides of the bed or the head and foot sides or on all four sides. It may be used with flat sheets, blankets or bedpads or with fitted sheets and the like.

Referring now to FIG. 6, an alternative embodiment of the invention is shown, in which the attachment of the batten to the cord or tape is by means of hook and loop fastening means. Permanently attached to the midpoint 8 of each batten is a piece of hook material 13 of the well known hook and loop fasteners. Attached to each end of a cord or tape 20 is a strip of loop material 14 for removably engaging hook material 13. At least one end 15 must have an elongate strip of loop material for adjustable adhering after sufficient tension has been applied to the tape and the batten. For simplicity of manufacture, the entire tape 20 may be made of the loop material. No special cord locking means is required with this embodiment, since attaching the hook and loop fastener together after applying tension will hold that tension.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. In a combination of a mattress, having an article of bedclothing thereon, with a retainer means for holding said article in flat and smooth position on said mattress, said mattress having broad upper and lower faces and narrow vertical sides, said retainer means comprising:

A) a hem means extending along at least two opposing edges of the article of bedclothing, each of said hem means provided with an aperture at a location intermediate the ends thereof;

B) an elongate, rigid batten means removably inserted within each said hem means for applying tension forces uniformly along each of said edges, each batten means provided with attachment means at a location substantially equidistant from the ends thereof, said attachment means arranged for access through said aperture;

C) an elongate, flaccid, tension member selected from the group consisting of cord, string, tape strip and ribbon, said tension member having a flaccid intermediate portion and two opposed flaccid end portions, each end portion provided with connecting means for removably attaching to said attachment means on said batten means when said intermediate portion passes beneath said lower face of said mattress and said end portions extend upward along opposed sides of said mattress said connecting means being spaced apart along said tension member by an adjustable distance therebetween, each of said end portions being provided with tension maintaining means for applying and maintaining tension on said connecting means by shortening the distance of said tension member between said connecting means to thereby pull said article of bedclothing down upon said mattress.

2. The retainer means according to claim 1, in which said tension maintaining means includes a cord locking mechanism.

3. The retainer means according to claim 2, in which said attachment means includes a hole through said batten means.

4. The retainer means according to claim 1, in which said attachment means, said connecting means and said tension maintaining means includes hook and loop fastening means.

5. The retainer means according to claim 1, in which said attachment means includes a hole through said batten means and said connecting means includes a hook.

6. The invention according to claim 1, in which said article is provided with four hems and four battens means and two tension members for applying tension to said article in transverse directions across the upper surface of said mattress.

7. The invention according to claim 1, in which said article is a fitted sheet.

8. The invention according to claim 1, in which tension may be applied by operation of said tension maintaining means from only one side of said bed.

9. In a combination of a mattress, having an article of bedclothing thereon, with a retainer means for holding said article in flat and smooth position on said mattress, said mattress having broad upper and lower faces and narrow vertical sides, said retainer means comprising:

A) a hem means extending along at least two opposing edges of the article of bedclothing, each of said hem means provided with an aperture at a location intermediate the ends thereof;

B) an elongate, rigid batten means removably inserted within each said hem means for applying tension forces uniformly along each of said edges, each batten means provided with attachment means at a location substantially equidistant from the ends thereof, said attachment means arranged for access through said aperture;

C) elongate, flaccid tension member means selected from the group consisting of cord, string, tape, strip and ribbon, said tension member means having a flaccid intermediate portion, and two opposed flaccid end portions, each end portion provided with connecting means for removably attaching to said attachment means on said batten means when said intermediate portion passes beneath said lower face of said mattress and said end portions extend upward along opposed sides of said mattress, said connecting means being spaced apart along each of said end portions being by an adjustable distance therebetween, said tension member means provided at both end portions with means for applying and maintaining downward tension to said attachment means by shortening the distance of said tension member means between said connecting means to thereby pull said article of bedclothing taut across said mattress.

* * * * *